US006874564B2

(12) United States Patent
Hugenschütt et al.

(10) Patent No.: US 6,874,564 B2
(45) Date of Patent: Apr. 5, 2005

(54) LIQUID-COOLED MOLD

(75) Inventors: Gerhard Hugenschütt, Belm (DE); Thomas Rolf, Osnabrück (DE); Dietmar Kolbeck, Steinfeld (DE); Hans-Günter Wobker, Bramsche (DE); Dirk Rode, Osnabrück (DE); Roland Hauri, Wettswil (CH); Hans-Dirk Piwowar, Osnabrück (DE); Hans-Jürgen Hemschemeier, Ennigerloh (DE)

(73) Assignee: KM Europa Metal AG, Osnabruck (GB)

( * ) Notice: Subject to any disclaimer, the term of this patent is extended or adjusted under 35 U.S.C. 154(b) by 0 days.

(21) Appl. No.: 10/643,412

(22) Filed: Aug. 18, 2003

(65) Prior Publication Data

US 2004/0069439 A1 Apr. 15, 2004

(30) Foreign Application Priority Data

Aug. 16, 2002 (DE) ..... 102 37 472

(51) Int. Cl.[7] ..... B22D 11/124

(52) U.S. Cl. ..... 164/418; 164/443; 164/72; 164/138; 164/435

(58) Field of Search ..... 164/418, 443, 164/72, 138, 435

(56) References Cited

U.S. PATENT DOCUMENTS

| | | | | | |
|---|---|---|---|---|---|
| 3,709,286 | A | * | 1/1973 | Bower, Jr. | 164/435 |
| 4,411,121 | A | * | 10/1983 | Blacklin et al. | 52/789.1 |
| 4,551,187 | A | * | 11/1985 | Church et al. | 148/411 |
| 4,688,320 | A | * | 8/1987 | Ushio et al. | 29/527.4 |
| 5,467,810 | A | * | 11/1995 | Grove | 164/418 |
| 6,354,358 | B1 | * | 3/2002 | Ishida | 164/72 |
| 6,742,571 | B2 | * | 6/2004 | Yamasaki et al. | 164/418 |

OTHER PUBLICATIONS

German Patent Application No. 197 16 451 A1.
European Patent Application No. 1138 417.

* cited by examiner

*Primary Examiner*—Tom Dunn
*Assistant Examiner*—I.-H. Lin
(74) *Attorney, Agent, or Firm*—Kenyon & Kenyon

(57) ABSTRACT

A liquid-cooled mold for a continuous casting of metals, including mold plates made of copper or a copper alloy, which are connected respectively to an adapter plate or a cooling-water tank by clamping bolts. The mold is characterized in that the clamping bolts are fastened to plateau pedestals which project in an island-like manner from the cooling arrangement side of the mold plate, which jut at least partially into a cooling arrangement gap formed between the mold plate and the adapter plate or the cooling-water tank, respectively, and have a streamlined shape adjusted to the flow direction of the cooling arrangement.

21 Claims, 3 Drawing Sheets

LIQUID-COOLED MOLD

FIELD OF THE INVENTION

The present invention relates to a liquid-cooled mold.

BACKGROUND INFORMATION

Liquid-cooled molds for the continuous casting of thin steel slabs are described in German Published Patent Application 197 16 450 A1, in which two broad face walls are provided which lie opposite to each other and are each composed of a copper plate and a steel supporting plate. The copper plates bordering on a mold cavity are detachably fastened to the supporting plates by metal bolts. The metal bolts are welded to the copper plates. In this connection, a nickel ring is used as weld filler material. Welding the metal bolts to the copper plate causes a point by point heat input, which brings with it disadvantageous changes in microstructure at the welding location. In addition, it is necessary to inspect the welding connection in the case of the usually applied bolt welding method. If a metal bolt is damaged, it has to be removed from the copper plate in a costly manner and replaced by a new metal bolt.

It is also known to mount threaded inserts directly into a copper mold plate, so that the mold plate may be fastened by screw bolts to an adapter plate or a cooling-water tank. However, in the case of mold plates of lower wall thickness, in this context, the safety distance between the bore bottom of the thread bush and the casting surface of the mold plate may be undershot. Usually, a safety distance of about 6 to 25 mm is necessary to allow the reworking of the casting side.

If the sum of the depth required for screwing in the threaded sleeves, and the distance required for the safe operation of the mold plates, between the bore bottom and the casting side is greater than the wall thickness of the mold plate, only the possibility remains of switching to the use of other, less effective connecting methods.

European Patent Application No. 1 138 417 describes a liquid-cooled plate mold for the continuous casting of metals, particularly of steel materials, in which the mold plates are connected by clamping bolts to a cooling-water tank or a supporting plate, respectively. The clamping bolts, in this context, engage with parts of mold positioned on the water side of each mold plate that are connected to the mold plate with force locking by soldering connections or by electron beam welding.

In the case of this solution, it is a disadvantage that, as a rule, additional recesses in the cooling-water tank or in the adapter plate have to be provided, in order that they may accommodate the fastening pieces protruding from the side of the cooling means of the mold plate. Furthermore, complementing cooling means channels have to be put into the mold plate or the adapter plate.

SUMMARY

The object of the present invention is to improve a liquid-cooled mold for the continuous casting of metals with respect to connecting copper mold plates, in particular those of low wall thickness, to an adapter plate or a cooling-water tank such that it allows a connection to the adapter plate or to the cooling-water tank, that is favorable from a flow technology point of view.

An additional object is seen in making available an also particularly wear-resistant mold having at the same time thin-walled mold plates.

To attain the first object, the present invention proposes a liquid-cooled mold for the continuous casting of metals, comprising: mold plates (1) made of copper or a copper alloy, which are connected respectively to an adapter plate (2, 2') or a cooling-water tank by clamping bolts (14, 14'), wherein the clamping bolts (14, 14') are fastened to plateau pedestals (7, 7') projecting island like from the cooling arrangement side (6) of the mold plate (1), which jut at least partially into a cooling arrangement gap (5) formed between the mold plates (1) and the adapter plate (2, 2') or the cooling-water tank, and have a streamlined shape adjusted to the flow direction (S) of the cooling arrangement. An essential component of the mold according to the present invention is the plateau pedestals rising like islands from the mold plate, which project into a cooling arrangement gap that is formed between the mold plate and the adapter plate or the cooling-water tank respectively. In this context, the plateau pedestals, or rather the spaces between the plateau pedestals, form the cooling arrangement gap, at least over a certain height range. At sufficient flow speed of the cooling arrangement, no further channels are necessary in the cooling arrangement side of the mold plate or in the side of the adapter plate facing the mold plate. Thus, the manufacturing technology expenditure is lower when using the solution of the present invention than in solutions having costly cooling arrangement guideways.

The form of the island-type plateau pedestals is chosen such that the flow resistance in the cooling arrangement gap is as low as possible. The plateau pedestals therefore have a streamlined shape adjusted to the flow direction of the cooling arrangement.

Especially when the clamping bolts engage with the threaded inserts fixed in the plateau pedestals, the mold according to the present invention offers the advantage of a conventional, detachable connection between the adapter plate or the cooling-water tank and the mold plate, and this, to be sure, even when extremely thin-walled mold plates are being used. The height of the plateau pedestals, in this context, may be selected as a function of the height of the threaded inserts. An especially low flow resistance occurs when the plateau pedestals are configured to be rhombus-shaped. However, low resistance values also occur when the plateau pedestals are drop-shaped in cross section or elliptical.

It is regarded as particularly advantageous if the mold plate is supported on the adjacent adapter plate or the adjacent cooling-water tank via the plateau pedestals. In that case, no additional distancing elements are required to form the cooling arrangement gap, since the plateau pedestals fix the distance between the mold plate and the adapter plate or the cooling-water tank, and consequently also determine the width of the cooling arrangement gap. That has the advantage that basically no additional channels or grooves for guiding the cooling arrangement have to be provided in the adapter plate or the mold plate. This means that the adapter plate and the mold plate may be designed to be flat on their cooling arrangement side, except where the plateau pedestals are, whereby the production expenditure for producing additional cooling arrangement channels or grooves basically drop out. One may optionally provide cooling arrangement channels or grooves both in the adapter plate and in the mold plate, at least from place to place.

A further advantage may be seen in the mold plate according to the present invention, in that the tensile forces acting upon the clamping bolts are directly introduced into the adapter plate or the cooling-water tank respectively, because of the support of the plateau pedestals on the adapter plate being immediately next to the through-hole. Because of that, as good as no bending torques are created in the mold plate.

An optimal introduction of the tensile forces coming from the clamping bolts into the mold plate occurs when the plateau pedestals have a rounded transitional region towards the mold plate. This avoids undesired notch stresses in the connect region of the plateau pedestals.

The plateau pedestals may be formed as one piece with the mold plate. For this, a milling technology processing of the cooling arrangement side of the mold plate is available, whereby the plateau pedestals are then shaped.

Within the scope of the present invention, it is also possible to produce the plateau pedestals as separate components and subsequently to connect them to the mold plate. Continuous material connecting methods, such as welding or soldering, are preferred. In the case of greatly different materials, bonding the plateau pedestals to the mold plate is also conceivable.

The mold plates may have a wall thickness less than 2.5 times the diameter of the clamping bolts. The diameters of the clamping bolts usually lie in the range of about 8 mm to about 20 mm.

The cooling arrangement gap is connected in a fluid-conducting way to the cooling arrangement ducts passing through the adapter plate. Because the cooling arrangement gap is in connection, via the cooling arrangement ducts, to the cooling tank that is downstream from the adapter plate, additional, lateral cooling arrangement supply lines, such as those made by deep drilling within the mold plate that are among the related art, are not required. In particular, cooling arrangement supply and disposal may be completely performed via the adapter plate, which for this purpose may be provided at regular intervals with cooling arrangement supplies and cooling arrangement disposals, so that the desired cooling of the mold is achieved.

Within the scope of the present invention, it is regarded as particularly advantageous if the mold plate of low wall thickness forms a preassembled plate unit with an adapter plate, which as such may overall be coupled to a cooling-water tank. Because of the low wall thickness of the mold plate, the integration of the cooling arrangement gap by the plateau pedestals, and because of the cooling arrangement ducts situated directly in the adapter plates, it is possible to use such plate units in exchange for mold plates of the same overall dimensions and connecting arrangement. Using such developed plate units, far stronger dimensioned mold plates made of copper or a copper alloy may be replaced completely and at a cost advantage. The use of a plate unit made of a mold plate and a reusable adapter plate is substantially more cost-effective than having to replace a massive mold plate made of copper or a copper alloy by a new one, after it has reached its wear limit. In the case of the mold according to the present invention, only the mold plate of low wall thickness has to be exchanged for a new mold plate or reworked on machines that have been used up to now. It is advantageous if the mold plate has a uniform wall thickness over its entire extension.

Particularly for achieving a high casting speed, and for increasing service life, mold plates made of a hardened copper material having a yield strength >300 Mpa may be used.

By using copper materials having a high yield strength, it is possible to reduce the wall thickness of the mold plate, measured between the cooling arrangement gap and the casting side, to measurements of the order of magnitude of about 5 mm to 25 mm, preferably 10 mm to 18 mm.

When the mold according to the present invention is used at high casting speeds, particularly at casting speeds greater than 5 m/min, the mold plate may have a length, measured in the casting direction, of about 1.0 m to 1.5 m, preferably between 1.1 m to 1.4 m.

As a function of the mechanical and thermal weighting to be expected, as well as the rigidity of the mold plate, the plateau pedestals may be positioned at a mutual distance of about 50 mm to 250 mm.

To compensate for thermal tensions, it is intended to incorporate a sliding aid making possible relative motions between the surface of the plateau pedestal and an adapter plate or a cooling-water tank. Relative motions are those that take place in the plane of the contacting surfaces of the plateau pedestals and the adapter plate or the cooling-water tank. The sliding aid may be provided both at the adapter plate or the cooling-water tank and/or the surface of the plateau pedestals. The sliding aid may especially be a coating based on polytetrafluoroethylene (PTFE). The use of sliding disks is also possible.

It is essential for the relative motion between the mold plate and the adapter plate in the connecting region that the clamping bolts permit such a relative displacement. Such clamping bolts, may basically penetrate through-holes in the adapter plate or the cooling-water tank with sufficient play. In addition, it is possible also to provide sliding aids below a bolt head securing the clamping bolt. These may be sliding disks or sliding coatings. In this context, the corresponding surface pairings have low coefficients of static friction and/or low coefficients of sliding friction, especially lower than 0.1. For this purpose, a corresponding surface may, for example, be chrome-plated, polished or hardened. It may also be imagined to incorporate elements below the screw head which make possible a relative motion of the screw bolt with respect to the components tensed up with one another. In this respect, for example, a disk having a spherical surface is conceivable, which on the one side or on both sides is supported on conical surface. A double cone/sphere combination makes possible, with respect to each surface pairing, a tilting motion, a lateral relative motion of the screw bolt being effected by the superimposition of these tilting motions in opposite directions.

The invention also improves the relative displaceability of the mold plate with respect to the adapter plate or a cooling-water tank, and this because the surfaces of the plateau pedestal lying adjacent to the adapter plate or to a cooling-water tank lie in planes that are parallel to one another. Thereby, consideration is given to the circumstance, especially in the case of mold plates having centrical bulging for shaping a funnel that the plateau pedestals situated in the region of the bulging define a different sliding plane in each case with the surfaces running tangentially to the bulging at a distance. Because of that, the sliding planes cross each other and are able to hinder an unhindered relative motion of the mold plates. This problem is solved by sliding planes running parallel to each other. In particular, because of the mutual alignment of the surfaces of the plateau pedestals or the sliding planes formed thereby, a specified expansion direction of a mold plate may be provided, without the occurrence of prestress of the mold plate with respect to the adapter plate or the cooling-water tank.

The mold plate may be provided with a diffusion barrier in the contact region with the steel melt that is thermally the most stressed, particularly in the height range of the casting bath level. Diffusion barriers may be formed from a metallic/metalloid material, but may also be made of lacquers, resins, or plastics, as well as ceramic materials. The diffusion barrier may be mounted in the upper half of the mold plate. It may have a thickness of 0.002 mm to 0.3 mm, especially a thickness of 0.005 mm to 0.1 mm. The diffusion barrier may also be developed as a multilayer layer, having a covering layer made of ceramic material. The covering layer assumes the function of a thermal barrier. The covering layer may be made of an oxide-ceramic material, such as aluminum oxide ($Al_2O_3$), zirconium oxide ($ZrO_2$) or magnesium oxide (MgO).

In addition, the mold plate may be provided with a wear-resistant layer, under the casting bath level in the casting direction, whose layer thickness increases in the casting direction. The lower half of the casting side of the mold plate may be equipped with such a wear-resistant layer. Since thin-walled mold plates have little wear volume, it is regarded as particularly advantageous if the wear-resistant layer grows slightly with respect to layer thickness in the casting direction, i.e. in the direction towards the bottom end of the mold plate. Thereby the wear-resistant layer may be developed wedge-shaped in cross section. The layer thickness may increase in this connection from about 0.1 mm to about 1 mm.

Nickel and nickel alloys are used as coating substances for the wear-resistant layers. Spraying methods for applying the material are also possible, such as high-speed flame spraying (HVOF), and wire spraying or plasma spraying methods, individually or in combination. The coating materials applied by spraying methods may be WCCo, for example, or the aforesaid oxide-ceramic materials, such as aluminum oxide ($Al_2O_3$), zirconium oxide ($ZrO_2$) or materials based on NiCrB.

BRIEF DESCRIPTION OF THE DRAWINGS

The present invention is described in greater detail below, using an exemplary embodiment represented in the drawings.

DETAILED DESCRIPTION

Figure 1:
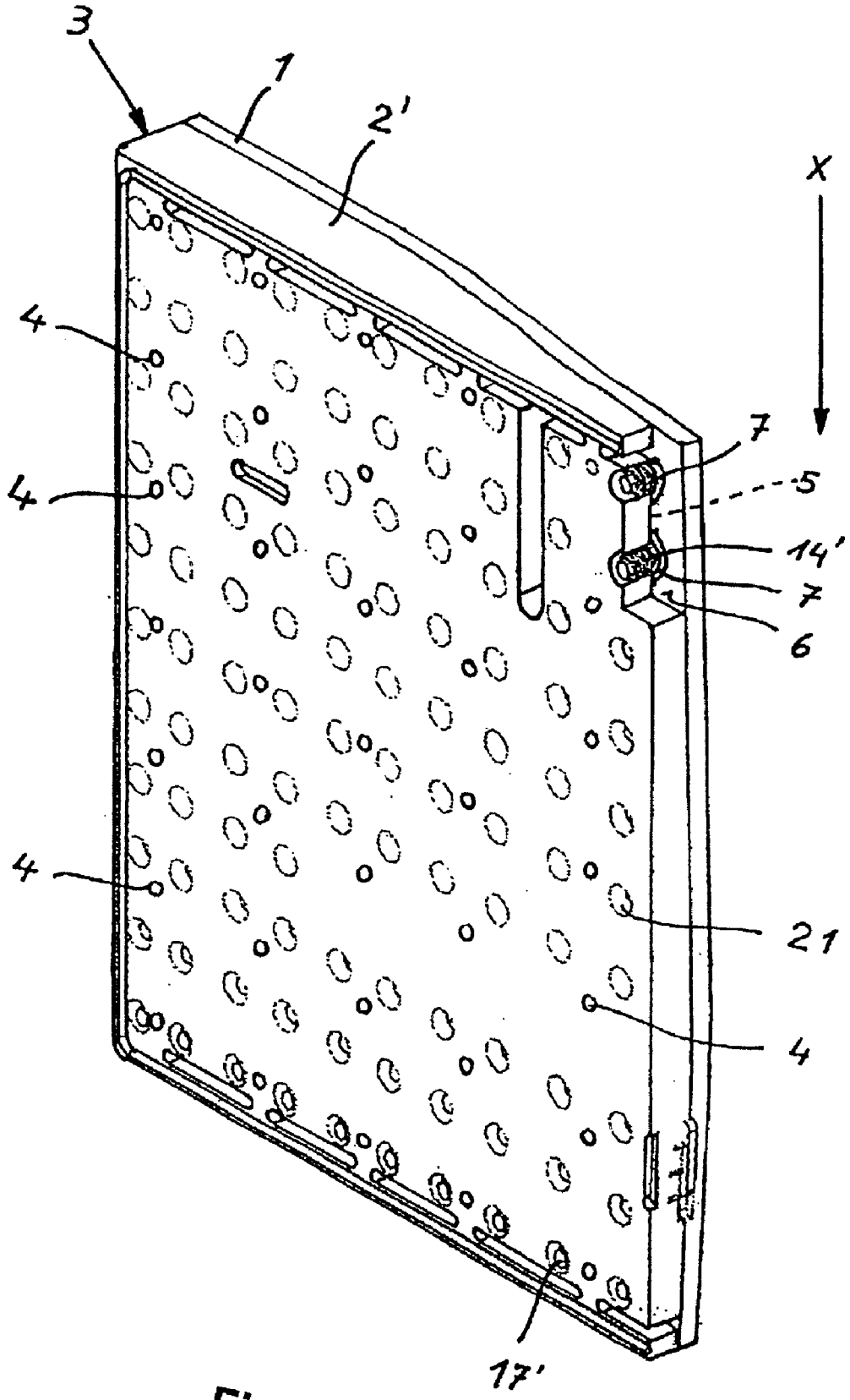
FIG. 1 is a perspective view of a rear plate unit formed from a mold plate and an adapter plate, partially in section.
Figure 5:
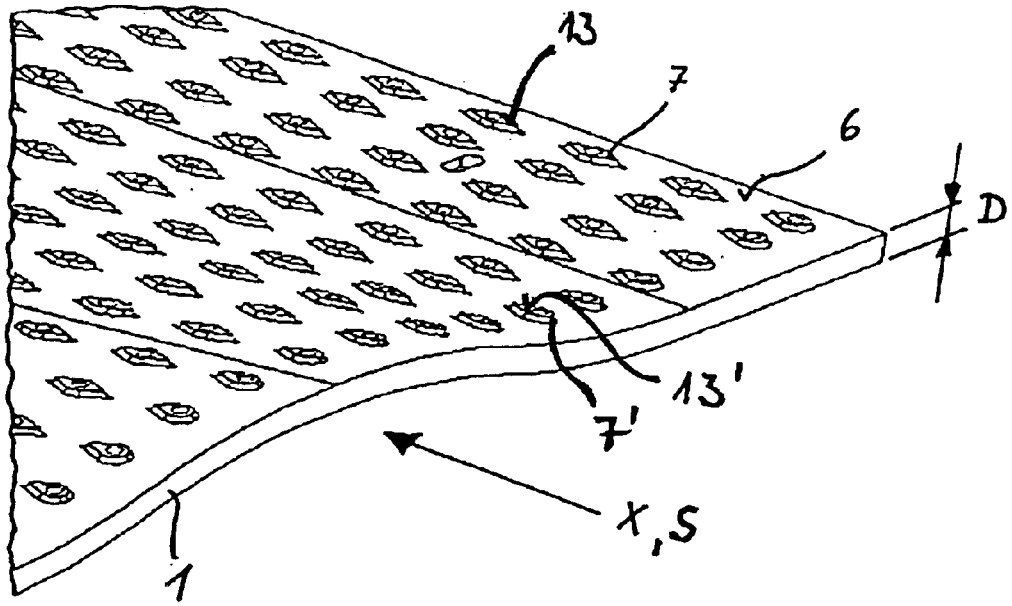
FIG. 5 is a perspective representation of a mold plate using a viewing direction towards a cooling arrangement side.

FIG. 1 illustrates a partial section of a mold plate 1 fastened to an adapter plate 2'. Mold plate 1 and adapter plate 2' form a plate unit 3 of a liquid-cooled mold for the continuous casting of metals. Plate unit 3 is only half shown here, the sectional plane extending in the right image half dividing plate unit 3 about centrically. Mold plane 1 is made of a copper alloy or a hardened copper material, having a yield point, for example, of >300 Mpa, and has a uniform wall thickness D over its entire extension (FIG. 5). Plate unit 3 is provided for being connected to a cooling-water tank, plate unit 3 being able to be quickly coupled to the cooling-water tank via quick assembly unions. Plate unit 3 overall is configured in its dimensions such that conventional mold plates of the same dimensions and connecting measurements may be completely replaced by plate unit 3, which is composed of an adapter plate 2' made of a steel material and relatively thin mold plate 1.

Figure 2:
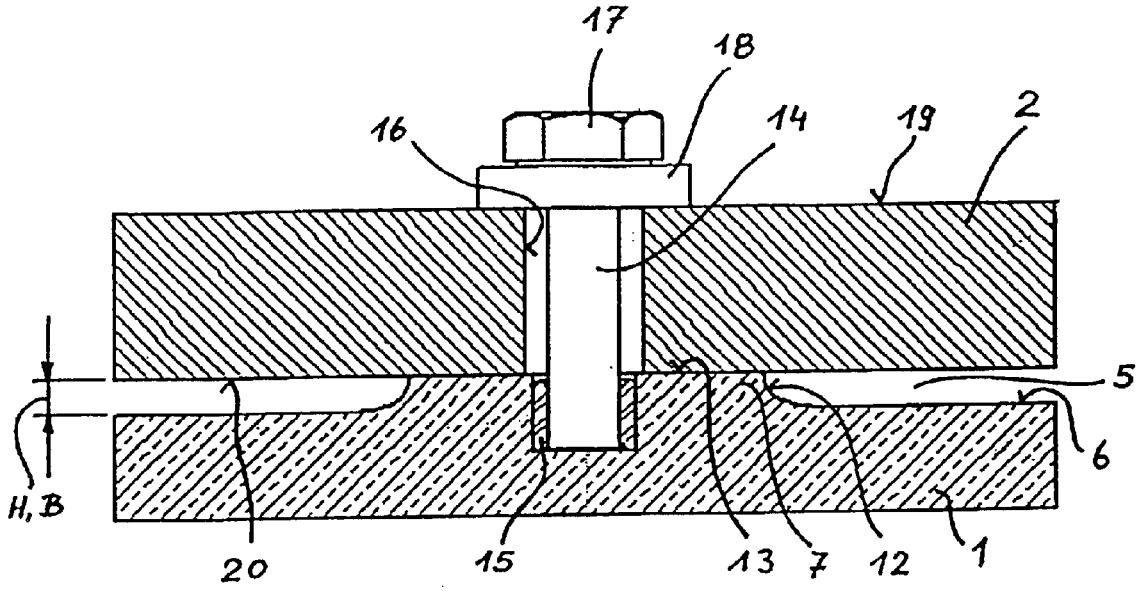
FIG. 2 is a cross section through an adapter plate and a mold plate in the vicinity of a plateau pedestal.
Figure 3:
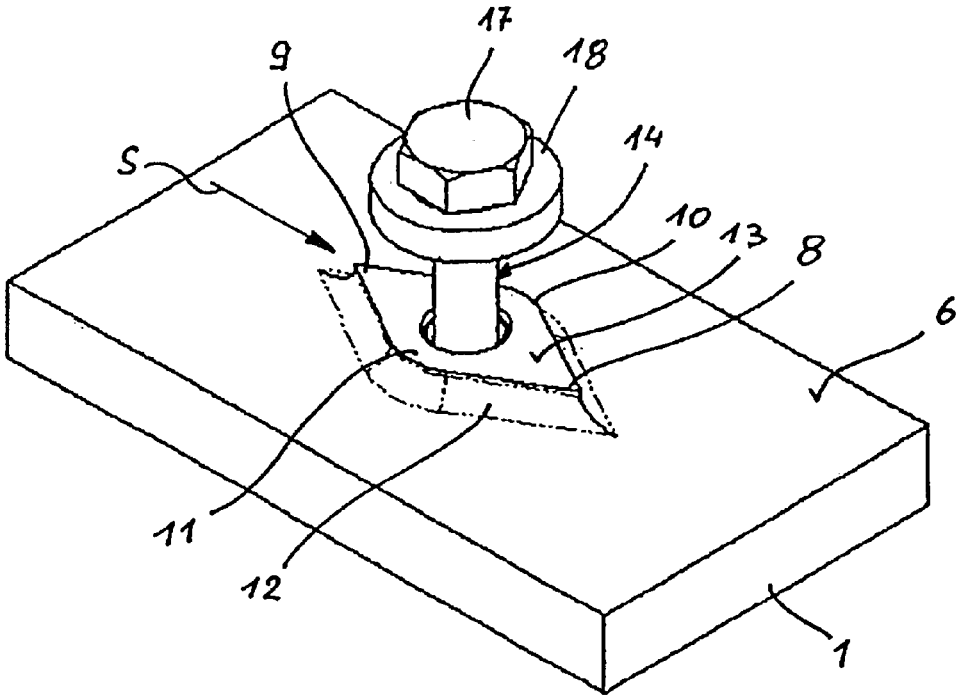
FIG. 3 is a perspective view of the cutout of a mold plate in the viewing direction towards a clamping bolt provided on the cooling arrangement side.

Adapter plate 2, 2' is provided with cooling medium ducts 4 for cooling mold plate 1 using a cooling arrangement. In this context, the cooling arrangement reaches cooling arrangement gap 5 formed between mold plate 1 and adapter plate 2, through cooling arrangement ducts 4 (FIG. 2). From FIG. 2 it becomes clear that cooling arrangement gap 5 is not inserted into adapter plate 2, but is determined in its width B by island-like plateau pedestals 7 protruding on cooling medium side 6 of mold plate 1. A possible shaping of plateau pedestals 7 may be seen in FIG. 3. Plateau pedestals 7 have an essentially rhombus-shaped configuration having respectively facing sharply pointed corners 8, 9 and rounded corners 10, 11. Plateau pedestal 7 has a greater longitudinal extension in the direction of pointed corners 8, 9 than in the direction of rounded corners 10, 11. Pointed corners 8, 9 of plateau pedestal 7 are adjusted, in this connection, to the flow direction which is clarified by arrow S. Overall, then, plateau pedestals 7 thereby have a streamlined shape. In this exemplary embodiment, plateau pedestals 7 are formed as one piece with mold plate 1. Plateau pedestals 7 also have a transition region 12 that is rounded going towards mold plate 1, the radius of transition region 12 in this exemplary embodiment essentially corresponding to height H of plateau pedestals 7. Height H of a plateau pedestal 7 is constant, so that surface 13 of plateau pedestal 7 is parallel to cooling arrangement side 6 of mold plate 1.

Into each plateau pedestal 7 of mold plate 1 there engages one clamping bolt 14. To accomplish this, one threaded insert 15 is anchored in each plateau pedestal, and into this is screwed clamping bolt 14. In the exemplary embodiment illustrated in FIG. 2, clamping bolt 14 goes, in this context, through a through-hole 16 in adapter plate 2. Bolt head 17 of clamping bolt 14, shaped hexagonal on the outside, is supported on cooling-water tank side 19 of adapter plate 2 via a disk 18. Clamping bolt 14 in this exemplary embodiment is screwed perpendicularly into mold plate 1. Within the scope of the present invention, it is also possible to select other angles for screwing in (the bolts), so as to achieve a load-adjusted fixing of mold plate 1 to adapter plate 2. That is, the angle of screwing in (the bolts) may deviate from 90°. So that bolt heads 17 may lie flat, for this purpose, either disk 18 may be developed slanting or cooling-water tank side 19 may be furnished with appropriately slanting recesses.

Clamping bolt 14 goes through through-hole 16 with play, so that a relative displacement, caused in particular thermally, of mold plate 1 with respect to adapter plate 2 is possible. For this, either surface 13 of plateau pedestal 7 and/or side 20 of the adapter plate facing adapter plate 2 may be furnished at least locally with a sliding aid making relative movements possible. The sliding aid may be a coating having a low coefficient of friction. This may be, for example, a material based on polytetrafluoroethylene (PTFE). The countersurface in contact with the sliding aid has an appropriately prepared surface so as to reduce static friction as well as sliding friction. For instance, surface areas may be locally polished, hardened or even coated, for example, chrome plated.

Sliding aids in the form of sliding disks may also be incorporated between the cooling plate and the adapter plate. The same measures are also possible on cooling-water tank side 19 of adapter plate 2 in the area of the support surface underneath bolt head 17. It may possibly be sufficient additionally to position a disk made of elastomeric material underneath the bolt head, in order to be able to adjust, in this manner, not only for relative displacements in the direction of cooling arrangement channel 15, but also to compensate for thermally caused changes in length in the direction of the clamping bolt.

Figure 4:
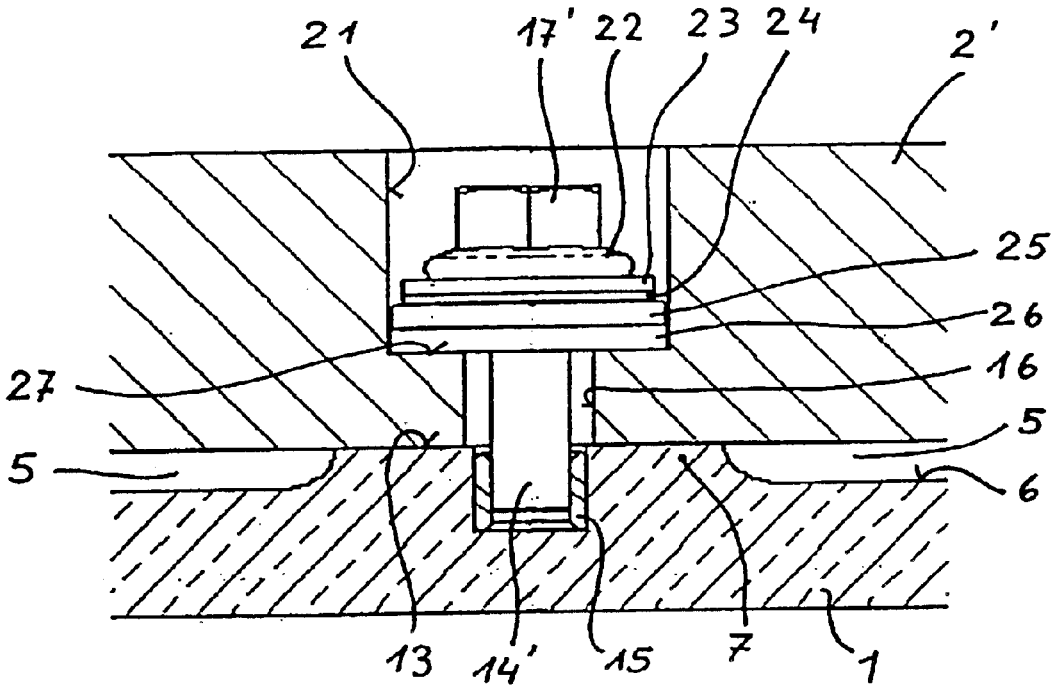
FIG. 4 is a section through a mold plate and an adapter plate in the vicinity of a plateau pedestal.

Such a specific embodiment is illustrated in the exemplary embodiment in FIG. 4. In this case, a clamping bolt 14', developed shorter compared to the specific embodiment in FIG. 2, including its bolt head 17', is let into a countersink 21. In particular because of the reduced length of clamping bolt 14', an arrangement for adjusting relative movements between adapter plate 2' and mold plate 1 are meaningful. For this purpose, in the exemplary embodiment in FIG. 4, a bolt head 17' is used which may be developed as one piece with clamping bolt 14', so that the clamping bolt is configured as a screw. However, it is also conceivable that one might shape bolt head 17' as a nut. In the direction towards mold plate 1, bolt head 17' has a widened collar 22 that may be joined on so that it is as one piece with it, so as to be able to absorb axial forces in optimal fashion. Below collar 22, there is possibly provided a disk of greater diameter 23, which is designed to be one piece with bolt head 17', which is furnished on one side with a sliding aid 24 in the form of a PTFE coating. To this lies adjacent a sliding disk 25, having a surface that fits PTFE coating 24. Sliding disk 25 has a greater diameter than coated disk 23, and may be chrome plated, polished or hardened.

Finally, below sliding disk 25, an elastic ring element 26 is incorporated, via which the necessary prestressing of the screw connection may be applied. Elastic ring element 26 is, for instance, a ring made of an elastomeric material such as rubber, or is formed from one or more springy elements. Finally, elastic ring element 26 rests on collar-like bore bottom 27 of countersink 21. In order to ensure a specified relative motion of clamping bolt 14' within through-hole 16' in adapter plate 2, the outer diameter of disk 23 that is coated with a sliding aid 24 is dimensioned smaller than the outer diameter of adjoining sliding disk 25. Sliding disk 25 and the elastic ring element are dimensioned only slightly smaller in their outer diameter than the diameter of the countersink, so that the tension force exerted by clamping bolt 14' is transmitted to entire bore bottom 27. Because of this, on the one hand, slight local compressive loads per unit area appear, and, on the other hand, a position orientation of sliding disk 25 with respect to PTFE-coated disk 23 is established.

It becomes clear from FIGS. 1 and 5 that the plateau pedestals are distributed uniformly grid-like over entire cooling arrangement side 6 of mold plate 1. In this exemplary embodiment, plateau pedestals 7 are oriented in perpendicular rows and gaps to one another, their pointed corners 8, 9 pointing in flow direction S of the cooling arrangement, which, in this exemplary embodiment, corresponds to casting direction X. Casting direction X and flow direction S may deviate from each other, and may, for instance, be directed in opposing directions.

Mold plate 1 has a contour commonly used in continuous casting, having a centrical bulging, its wall thickness D, measured between cooling arrangement side 6 and casting side 28, being constant over its entire extension. Only plateau pedestals 7, 7' jut out like islands from cooling arrangement side 6.

Plateau pedestals 7, 7' have surfaces 13, 13' which, in the specific embodiment illustrated, are aligned parallel to cooling arrangement side 6 of mold plate 1 that directly surrounds them. If cooling arrangement side 6 is bent, as is the case in the region of the bulging, surface 13' of plateau pedestals 7' located there may be aligned tangentially to the bending of the bulging. That is, plateau pedestals 7, 7' are in principle positioned perpendicular to each corresponding surface area of cooling arrangement side 6.

However, it is also possible that all surfaces 13, 13' of plateau pedestals 7, 7' are aligned parallel to one another. Then the surfaces of plateau pedestals 7' of the bulging are not positioned tangentially to cooling arrangement side 6, but include different angles with cooling arrangement side 6, depending on their positioning at the bulging. The advantage is, that all plateau pedestals 7, 7' have a defined, equidirectional displacement direction, whereby tensions in mold plate 1 are further reduced.

LIST OF REFERENCE NUMERALS

1—mold plate
2—adapter plate
2'—adapter plate
3—plate unit
4—cooling arrangement duct
5—cooling arrangement gap
6—cooling arrangement side
7—plateau pedestal
7'—plateau pedestal
8—corner of 7
9—corner of 7
10—corner of 7
11—corner of 7
12—transition region
13—surface of 7
13'—surface of 7'
14—clamping bolt
14'—clamping bolt
15—threaded insert
16—through-hole
16'—through-hole
17—bolt head
17'—bolt head
18—disk
19—cooling-water tank side
20—side of 2
21—countersink in 2'
22—collar of 17'
23—disk
24—sliding aid
25—sliding disk
26—elastic ring element
27—bore bottom
28—casting side
B—width of 5
D—wall thickness
H—height of 7
S—flow direction
X—casting direction

What is claimed is:

1. A liquid-cooled mold for continuous casting of metals, comprising:

mold plates made of one of copper and a copper alloy, which are connected respectively to one of an adapter plate and a cooling-water tank by clamping bolts, wherein the clamping bolts are fastened to plateau pedestals projecting from a cooling arrangement side of the mold plate, which jut at least partially into a cooling arrangement gap formed between the mold plates and one of the adapter plate and the cooling-water tank, and have a streamlined shape adjusted to a flow direction of the cooling arrangement wherein each pedestal is configured in a rhombus shape.

2. The mold according to claim 1, wherein the clamping bolts engage with threaded inserts fixed in the plateau pedestals.

3. The mold according to claim 1, wherein the plate is provided with a diffusion barrier in a contact region with a steel melt that is thermally most stressed, in a height range of casting bath level.

4. The mold according to claim 1, wherein the mold plate is supported via the plateau pedestals on one of the adjoining adapter plate and on the adjoining cooling-water tank.

5. The mold according to claim 1, wherein the plateau pedestals have a transition region that is rounded towards the mold plate.

6. The mold according to claim 1, wherein the plateau pedestals are formed as one piece with the mold plate.

7. The mold according to claim 1, wherein the plateau pedestals are connected integrally to the mold plate.

8. The mold according to claim 1, wherein the mold plates have a wall thickness which is less than 2.5 times the diameter of the clamping bolts.

9. The mold according to claim 1, wherein the cooling arrangement gap is connected in a fluid-conducting manner to the cooling arrangement ducts which penetrate the adapter plate.

10. The mold according to claim 1, wherein a mold plate with a small wall thickness and the adapter plate form a preassembled plate unit connectible to a cooling-water tank, for exchanging with mold plates of the same overall dimensions and connecting measurements as the plate unit.

11. The mold according to claim 1, wherein the mold plate is made of an aged copper material having a yield strength of more than 300 Mpa.

12. The mold according to claim 1, wherein a wall thickness of the mold plate measured between the cooling arrangement channel and the casting side is between 5 mm and 25 mm.

13. The mold according to claim 1, wherein the mold plate has a length of 1.0 through 1.5 m as measured in a casting direction.

14. The mold according to claim 1, wherein the plateau pedestal is positioned at a mutual distance of approximately 50 mm through 250 mm.

15. The mold according to claim 1, wherein a sliding aid making easier relative motions is incorporated between the surface of the plateau pedestals and one of an adapter plate and a cooling-water tank.

16. The mold according to claim 15, wherein the sliding aid is a coating based on polytetrafluoroethylene.

17. The mold according to claim 16, wherein the sliding aid is a sliding disk.

18. The mold according to claim 1, wherein the clamping bolts allow a relative displacement of the mold plate with respect to one of the adjoining adapter plate and to the adjoining cooling-water tank.

19. The mold according to claim 1, wherein the surfaces of the plateau pedestals lying up against one of an adapter plate and against a cooling-water tank lie in planes that are parallel to one another.

20. The mold according to claim 1, wherein the mold plate are provided with a wear-resistant layer below the casting bath level casting direction, a layer thickness of the wear-resistant layer increasing in the casting direction.

21. The mold according to claim 20, wherein the layer thickness increases from approximately 0.1 mm to approximately 1 mm.

* * * * *